United States Patent [19]

Merkel

[11] 4,088,496

[45] May 9, 1978

[54] HEAT DEVELOPABLE PHOTOGRAPHIC MATERIALS AND PROCESS

[75] Inventor: Paul Barrett Merkel, Rochester, N.Y.

[73] Assignee: Eastman Kodak Company, Rochester, N.Y.

[21] Appl. No.: 753,236

[22] Filed: Dec. 22, 1976

[51] Int. Cl.[2] ..... G03C 1/02; G03C 1/72; G03C 1/34

[52] U.S. Cl. ..... 96/114.1; 96/109; 96/114.6

[58] Field of Search ..... 96/114.1, 109, 61, 91, 96/95, 66.4, 114.6

[56] References Cited

U.S. PATENT DOCUMENTS

| | | | |
|---|---|---|---|
| 3,220,839 | 11/1965 | Herz et al. | 96/61 |
| 3,375,115 | 3/1968 | Smith et al. | 96/109 |
| 3,506,444 | 4/1970 | Haist et al. | 96/61 |
| 3,535,115 | 10/1970 | Weber | 96/109 |
| 4,012,260 | 3/1977 | Dickerson et al. | 96/114.1 |

*Primary Examiner*—Edward C. Kimlin
*Assistant Examiner*—Alfonso T. Suro Pico
*Attorney, Agent, or Firm*—Richard E. Knapp

[57] ABSTRACT

An activator precursor, which is preferably an activator-stabilizer precursor, containing a base portion and an acid portion has improved properties when the acid portion is a 2-carboxycarboxamide. The activator precursors are useful in photographic materials which are responsive to heat for processing. The activator stabilizers have improved coating properties and do not release undesirable volatile materials upon heating.

28 Claims, No Drawings

HEAT DEVELOPABLE PHOTOGRAPHIC MATERIALS AND PROCESS

BACKGROUND OF THE INVENTION

1. Field of the Invention

This invention relates to certain activator precursor compounds, especially activator-stabilizer precursor compounds, for use in photographic materials for processing with heat. More particularly, this invention relates to such compounds wherein the acid portion of the compound is a 2-carboxycarboxamide. One aspect of the invention relates to heat developable and heat stabilizable photographic elements comprising the described 2-carboxycarboxamide compounds. Another aspect relates to photographic compositions for processing with heat containing these compounds. A further aspect relates to a heat activatable photographic processing composition containing the described activator precursors, especially activator-stabilizer precursors.

2. Description of the State of the Art

It is known to provide photographic elements that are heat processable, particularly heat developable. That is, photographic elements are known wherein a latent image can be developed by heating the element. Typically, such elements contain photosensitive silver halide, a silver halide developing agent, a developing agent activator precursor and, typically, a stabilizer precursor to provide improved stability to the developed image. Upon development by application of heat, the developer, activator and stabilizer are released from their respective precursors. Development of the latent image and stabilization occur substantially simultaneously as the result of two competing reactions. It is necessary to provide an activator precursor, particularly an activator-stabilizer precursor, that permits the respective reactions to take place without adversely affecting the desired sensitometric properties of the element.

A heat developable photographic element is known wherein an image is developed, for example, by a developing agent that is activated by the decarboxylation products of organic acids. This is described, for example, in U.S. Pat. No. 3,220,846 of Sagura and Tinker, issued Nov. 30, 1965. An example of such a heat developable photographic material contains piperidine trichloroacetate that decarboxylates upon heating to provide piperidine, carbon dioxide and chloroform. The piperidine activates the developing agent in the photographic material while the chloroform, that is volatile at processing temperatures, and the carbon dioxide are released into the binder of the photographic material. This release of gases is often undesirable, particularly in microimaging.

Other heat developable photographic and, in some cases, heat stabilizable photographic materials are described, for instance, in U.S. Pat. No. 3,301,678 of Humphlett, Johnson and Haist, issued Jan. 31, 1967; British Patent No. 1,161,777 published Aug. 20, 1969; U.S. Pat. No. 3,152,904 of Sorenson et al, issued Oct. 13, 1964; British Patent No. 1,131,108 published Oct. 23, 1968; U.S. Pat. No. 3,392,020 of Yutzy et al, issued July 9, 1968; German Patent No. 888,045 published Aug. 27, 1953; and British Patent No. 930,572 published July 3, 1963. Use of base-release agents, or activator precursors, is described in certain of these heat processable photographic materials.

It is known to incorporate stabilizer precursors in heat developable photographic materials. Certain sulfur-containing compounds can be heat activated to release a stabilizing moiety in the photographic materials. This is described, for example, in U.S. Pat. No. 3,301,678 of Humphlett, Johnson and Haist, issued Jan. 31, 1967. It is believed that the sulfur-containing stabilizer precursor breaks down or "cleaves" at processing temperatures to provide a moiety that combines with the silver halide in the unexposed and undeveloped areas of the photographic material. The resulting silver mercaptide is more stable than silver halide to light, atmospheric and ambient conditions. Typically, the stabilizer precursors described are isothiuronium compounds.

Certain bis-isothiuronium compounds having an intermediate ureylene or ether moiety between isothiuronium moieties are also known as activator-stabilizers. These are described, for example, in U.S. Pat. No. 3,669,670 of Haist and Humphlett, issued June 13, 1972. Heating of these activator-stabilizer precursors releases both a development activator moiety and a stabilizer moiety. These compounds, however, have resulted in one or more disadvantages including: (1) the requirement of larger concentrations of processing chemicals than desired, (2) in many cases obnoxious odors upon heat processing, and (3) less than desired post-processing image stability.

In U.S. Ser. No. 551,182 of D. G. Dickerson and P. B. Merkel, filed Feb. 19, 1975 entitled "Activator-Stabilizers in Heat Developable Photographic Materials and Processes", now U.S. Pat. No. 4,012,260, and in Research Disclosure, Volume 140, Dec. 1975, Item 14049, published by Industrial Opportunities Ltd., Homewell, Havant, Hampshire, P09 1EF, UK, certain 2-amino-2-thiazolium carboxylates are described as activator-stabilizer precursors in heat processable photographic materials. Upon heating the photographic material containing these compounds, the activator-stabilizer precursors release an agent that is capable of activating a developing agent in the material. The precursors also release a moiety which is capable of stabilizing a silver halide image in the material. Although the described activator-stabilizer precursors are useful in heat developable photographic materials, these carboxylate compounds have certain drawbacks. The byproducts formed by the decarboxylation of the precursors are undesirably volatile at processing temperatures. These volatile byproducts are released into the photographic material along with carbon dioxide. Examples of the byproducts that are given off by certain of these activator precursors include chloroform, acetaldehyde and methyl cyanide. These compounds which can escape into the environment are highly toxic gases. In addition to their undesired toxicity, these gases along with carbon dioxide released by the decarboxylation can form undesirable bubbles in the heat processable photographic material. This is particularly disadvantageous in microfilm applications.

In copending application U.S. Ser. No. 712,459 of Merkel and Ling, filed Aug. 6, 1976 heat developable and heat stabilizable photographic silver salt materials are described containing an activator-stabilizer precursor having a base portion and an acid portion wherein the acid portion is an $\alpha$-sulfonylacetate. Such activator-stabilizer precursors provide activation and stabilization without significant volatile byproducts of decarboxylation, except $CO_2$. However, it has been noted that the compounds containing the α-sulfonylacetate do provide a disadvantage in that the photographic materials upon processing containing these activator stabilizers have what are described in the photographic art as "pinholes". "Pinholes" as described herein mean small areas of low density in the photographic material that can be readily observed visually through a 10X magnifying observation means. The "pinholes" are most readily apparent in the maximum density areas of the developed photographic material. The following comparative Example 3 illustrates a photographic material which contains undesirable "pinholes". Processed samples of the material, according to this example, contain roughly several hundred "pinholes" per square centimeter averaging approximately 0.05 millimeters in diameter. This property is particularly disadvantageous in microimaging.

Thus, there has been a continuing need for improved activator precursors, especially activator-stabilizer precursors that have byproducts which have reduced toxicity and volatility and reduce the number of undesired "pinholes" in heat processable photographic materials, especially those designed for microimaging. In addition, there has been a need to provide activator-stabilizer precursors in heat processable photographic materials which do not provide byproducts that contribute to bubble formation and also do not significantly adversely affect the desired sensitometric properties of the photographic material. The described art provides no guidance for the selection of an improved acid anion in an activator precursor, especially an activator-stabilizer precursor, in a heat processable photographic material that provides the desired combination of properties.

SUMMARY OF THE INVENTION

According to this invention, these described properties are provided in a heat developable photographic material and process by an activator precursor, especially an activator-stabilizer precursor, having a base portion and an acid portion wherein the acid portion is a 2-carboxycarboxamide, as described herein. An especially useful embodiment of the invention is one in which the activator precursor is also a stabilizer precursor that upon heating releases a moiety which provides post-processing stabilization. Such an activator precursor, particularly an activator-stabilizer precursor, provides, upon heating, the required activation of a developing agent in the heat processable material and post-processing stabilization without the deleterious physical effects of the volatile byproducts of decarboxylation and without the undesired "pinhole" effect observed in some heat processable materials, especially those used for microimaging. In addition, the 2-carboxycarboxamide compounds have been found to provide reduced toxicity and do not adversely affect the desired sensitometric properties of the heat processable material. Heat processable photographic materials containing the 2-carboxycarboxamide compounds also have improved keeping properties.

DETAILED DESCRIPTION OF THE INVENTION

The activator precursors, especially the activator-stabilizer precursors, as described can be prepared by processes known in the art. An example of the process of preparing a 2-carboxycarboxamide is described in *J. Chem. Soc.*, 127, 1791 (1925). The preparation of N,N'-ethylenebis(phthalamic acid) is an example of preparation of the 2-carboxycarboxamide moiety as described. According to this preparation, 7.0 grams of ethylenediamine dissolved in 100 ml of suitable solvent is poured into a solution of 40.0 grams (that is a 15% excess) of phthalic anhydride in 300 ml of acetonitrile plus 100 ml of a suitable solvent (3A alcohol) with vigorous stirring. A white solid forms initially which soons dissolves followed by formation of a white precipitate. The covered solution is stirred for 1 hour at ambient temperature (about 20° C) and pressure. The resulting product is filtered and washed with ether. This can be dried to provide the desired N,N'-ethylenebis(phthalamic acid). The desired product is essentially water insoluble, but soluble in methanol or an aqueous base solution. It decomposes between about 155° C and 195° C with evolution of water. This desired product can be mixed with the base portion of the described activator precursor or stabilizer-activator precursor to provide the desired product for use in a heat processable photographic material according to the invention. This mixing of the acid and base moieties can be carried out in situ with other components of the heat processable photographic material, that is, the acid moiety and base moiety can be mixed with the developing agent, binder and other components to provide the desired heat processable photographic material. In other cases, it can be desirable to mix the acid and base moieties of the described activator precursor separate from other components of the heat processable material in order to provide increased desired control of the preparation. This mixing can be carried out under ambient conditions of pressure and temperature, such as at about 20° C and atmospheric pressure. Mixing of the acid and base moieties is usually carried out at stoichiometric ratios, however, concentrations outside these ratios can be useful in order to insure reaction completion. The desired product can be purified using means known in the art; however, the impure product containing free phthalamic acid and the free base moiety can also be useful.

One embodiment of the invention is an improved heat developable photographic element comprising a support having thereon, in reactive association, (a) a photographic silver salt, especially photographic silver halide, (b) a photographic silver salt developing agent, as described herein, (c) a binder, typically a polymeric binder, and (d) an activating concentration of an activator precursor, especially an activator-stabilizer precursor having a base portion and an acid portion. The improvement comprises, as the acid portion, a 2-carboxycarboxamide, as described.

The activator precursor compounds, especially the activator-stabilizer precursor compounds, as described, are represented by the formula:

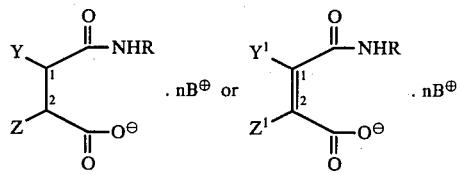

wherein B is a basic nitrogen containing moiety, especially a protonated basic nitrogen containing moiety; Y, Y', Z and Z' are each selected from the group consisting of hydrogen and alkyl, especially alkyl containing 1 to 4 carbon atoms, such as methyl, ethyl, propyl and butyl, or Y' and Z' together represent the atoms necessary to complete a phenylene group; R is selected from the group consisting of hydrogen, alkyl containing 1 to 10 carbon atoms, such as methyl, ethyl, propyl, butyl and hexyl, and carboxamido, especially

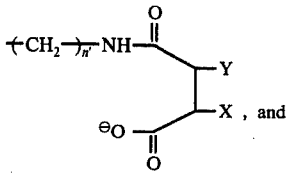

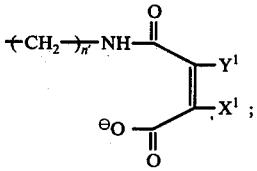

$n'$ is 1 to 6; X is the same as Z and X' is the same as Z'; $n$ is an integer depending on the nature of the acid and base moieties sufficient to form a neutral compound, especially 1 or 2. A neutral compound, as described herein, is intended to mean a compound that has a net charge of zero. That is, the compound is neutralized because the number of acid groups is balanced by the number of basic groups with none in excess. The term "protonated" herein is intended to mean that one or more hydrogen ions ($H^+$) are bound to an amine moiety forming a positively charged species.

Alkyl, alkylene and phenylene are intended to include alkyl, alkylene and phenylene that are unsubstituted or contain substituents which do not adversely affect the sensitometric or other desired properties of the heat developable photographic material as described. Suitable substituent groups include, for example, hydroxyl, carboxamido and carbamoyl.

Especially useful activator precursors, including activator-stabilizer precursors as described, are those wherein B is an amine or isothiuronium moiety, particularly such a moiety having a pKa value within the range of 8 to 12 and wherein the 2-carboxycarboxamide undergoes less than 10% weight loss, except loss due to water release, in a thermogravimetric scan between 30° C and about 180° C where the scan rate is about 40° C per minute. A detailed description of thermogravimetric analysis can be found in *Instrumental Methods of Analysis* by Willard, Merritt and Dean, Vanostrand, 1965, Chapter 17. Such a test can demonstrate the desired degree of lack of volatility of the byproducts of the precursors in the photographic materials of the invention. The analysis, as described, involves the weight loss measurement of a sample as a function of temperature at a given rate of temperature increase.

The exact mechanism by which the precursors, as described, function within a heat processable photographic material according to the invention is not fully understood. It is believed that, upon heating, the precursor undergoes a thermal cyclization of the acid portion of the precursor producing an imide and also liberates a base or base stabilizer moiety. This is illustrated, for example, in the following equation:

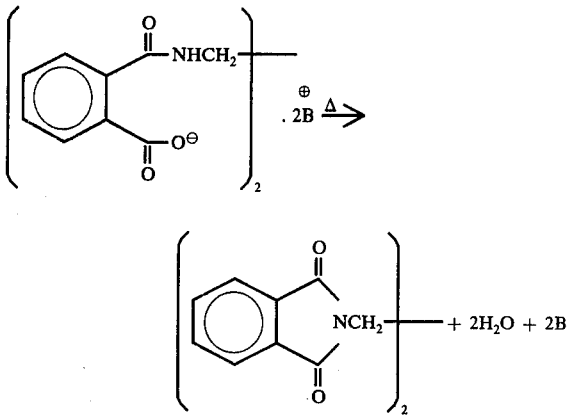

B, as described, can be any of a variety of protonated basic nitrogen containing moieties that do not significantly adversely affect the desired properties, such as sensitometric properties, of the described photographic materials. Especially useful base moieties are amine and isothiuronium moieties as described herein. The amine and isothiuronium moieties which are useful have a pKa value within the range of 8 to 14, typically 8 to 12. Especially useful amine or isothiuronium moieties are those represented by the formula:

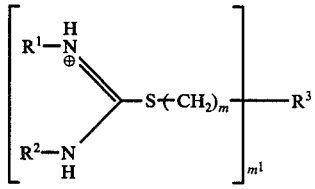

wherein $m$ is 2 to 6; $m^1$ is 1 or 2; $R^1$ and $R^2$ are independently selected from the group consisting of hydrogen and alkyl, especially alkyl containing 1 to 5 carbon atoms, such as methyl, ethyl, propyl and butyl or are the carbon atoms necessary to complete a five- or six-member heterocyclic nucleus, such as

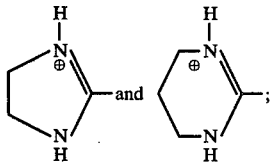

$R^3$ is a group that reduces volatility of the described precursor, especially a group that is

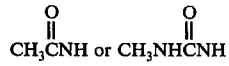

when $m^1$ is 1; or, when $m^1$ is 2, is

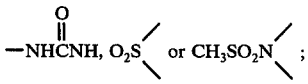

and

-continued

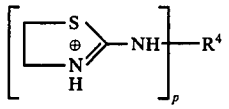

wherein $p$ is 1 or 2; $R^4$, when $p$ is 1, is selected from the group consisting of hydrogen and alkyl, especially alkyl containing 1 to 3 carbon atoms, such as methyl, ethyl, and propyl; $R^4$, when $p$ is 2, is alkylene, especially alkylene containing 1 to 6 carbon atoms, such as methylene, ethylene, propylene and butylene. In the case of a precursor containing a moiety within formulas I or II as described, the precursor is both an activator precursor and a stabilizer precursor.

In certain cases it is not necessary to have the base portion of the precursor as described be a stabilizer precursor as well as an activator precursor. In those instances, an activator precursor having a pKa within the range of 8 to 12 and represented by the formula is especially useful:

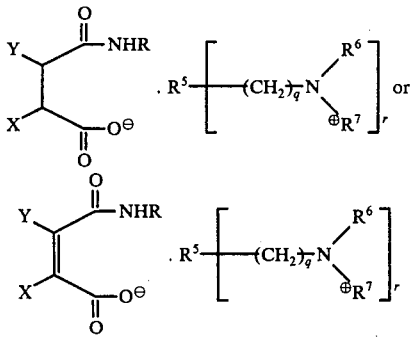

wherein Y, X, $Y^1$ and $X^1$ are independently selected from the group consisting of hydrogen and alkyl, especially alkyl containing 1 to 4 carbon atoms, or $Y^1$ and $X^1$ together represent the atoms necessary to complete a phenylene group; R is selected from the group consisting of hydrogen, alkyl containing 1 to 10 carbon atoms, such as methyl, ethyl, propyl, butyl and hexyl, and carboxamido, especially

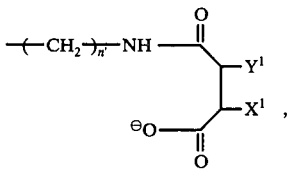

and

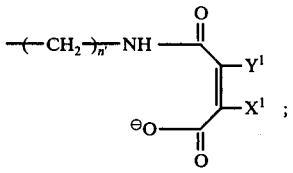

$n'$ is 1 to 6; $q$ is 1 to 6; $r$ is 1 or 2; $R^6$ and $R^7$ are each selected from the group consisting of hydrogen, alkyl, especially alkyl containing 1 to 4 carbon atoms such as methyl, ethyl, propyl and butyl; $R^5$, when $r$ is 2, is selected from the group consisting of

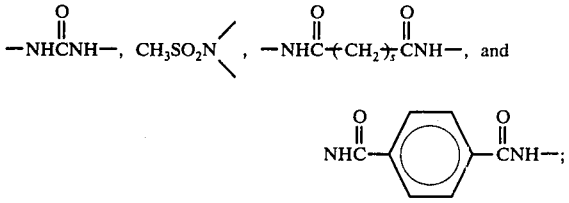

$s$ is 1 to 6; $R^5$, when $r$ is 1, may be

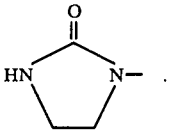

The described activator precursor containing the 2-carboxycarboxamide moiety should undergo less than 10% weight loss, except loss due to water release, in a thermogravimetric scan between about 30° C and about 180° C where the scan rate is about 40° C per minute, as described.

Selection of an optimum activator precursor, especially an activator-stabilizer precursor, or combination of compounds, as described, will depend upon a variety of factors, such as the particular image desired, processing conditions, particular photographic silver salt, other components of the photographic material, the degree of desired image stability and the like. One selection test, for example, is described in following Example 1. In this example the compound within the above description can be tested in the material of Example 1 in place of the described 2-carboxycarboxamide compound in that example. If the results of the test provide similar results to those of Example 1, the 2-carboxycarboxamide compound is considered satisfactory. That is, in the case of an activator precursor, the compound is considered satisfactory if an image is developed having about the same maximum and minimum density as the image developed according to Example 1. In the case of an activator-stabilizer precursor, the compound is considered satisfactory if an image is developed and the maximum density of the developed image should be at least about as high as that of the image developed according to Example 1.

An especially useful heat developable photographic material according to the invention is one wherein the activator precursor is an activator-stabilizer precursor containing an N,N'-ethylenebis(phthalamic acid) moiety.

An especially useful activator-stabilizer precursor, as described, is 1,3-bis(2-amino-2-thiazolinyl)propane · N,N'-ethylenebis(phthalamic acid).

Combinations of activator precursors, especially combinations of activator-stabilizer precursors, as described, can be useful according to the invention, if desired.

Some of the activator precursor compounds, typically activator-stabilizer precursor compounds, have limited solubility in aqueous formulations and may require some added solvents in the preparation of photographic compositions.

The photographic materials, as described, contain a photographic silver salt, preferably photosensitive silver halide due to its high degree of photosensitivity.

Useful photographic silver salts other than photosensitive silver halide include, for example, certain silver triazoles and silver aminotriazoles. The term "photosensitive silver halide" as used herein is intended to include photographic silver halide. Useful photographic silver halides include, for example, silver chloride, silver bromide, silver bromoiodide, silver chlorobromoiodide or mixtures thereof. The photographic silver halide can be coarse or fine grain. The materials containing the photographic silver halide can be prepared by any of the well-known procedures in the photographic art, such as single-jet emulsions, double-jet emulsions, such as Lippmann emulsions, ammoniacal emulsions, thiocyanate or thioether ripened emulsions and the like, such as described in U.S. Pat. No. 2,222,264 of Nietz et al, issued Nov. 14, 1940; U.S. Pat. No. 3,332,069 of Illingsworth, issued May 15, 1967 and U.S. Pat. No. 3,271,157 of McBride, issued Sept. 6, 1966. Surface image silver halide materials can be useful or internal image silver halide materials can be used, such as those described in U.S. Pat. Nos. 2,592,250 of Davey et al, issued Apr. 8, 1952; 3,206,313 of Porter et al, issued Sept. 14, 1965; 3,367,778 of Berriman et al, issued Feb. 6, 1968 and 3,447,927 of Bacon et al, issued June 3, 1969. If desired, mixtures of surface image and internal image silver halide materials can be useful as described in U.S. Pat. No.2,996,382 of Luckey et al, issued Apr. 15, 1961. Silver halide materials can be regular grain silver halide materials such as the type described in Klein and Moisar, *Journal of Photographic Science,* Volume 12, No. 5, September–October 1964, pages 242–251 and German Patent No. 2,107,118. Negative type silver halide materials can be useful as well as direct-positive silver halide materials. The activator-stabilizer precursors, as described, are particularly useful with silver bromide and silver bromoiodide materials. A range of concentration of photographic silver salt can be useful in the photographic materials of the invention. Typically, a concentration of photographic silver salt, especially photographic silver halide, is used that, when coated on a support, provides a photographic element containing about 1 to about 30 mg of silver per square decimeter.

A silver salt developing agent, typically a silver halide developing agent, is useful in the photographic materials and processes as described to provide a developed image. Useful silver salt developing agents, typically silver halide developing agents, include, for example, polyhydroxybenzenes such as hydroquinone developing agents, including, for example, hydroquinone, alkyl-substituted hydroquinones, such as tertiary-butylhydroquinone, methylhydroquinone, 2,5-dimethylhydroquinone and 2,6-dimethylhydroquinone; catechols and pyrogallol; chlorohydroquinone or dichlorohydroquinone; alkoxy-substituted hydroquinones such as methoxyhydroquinone or ethoxyhydroquinone; methylhydroxynaphthalene; methylgallate; aminophenol developing agents, such as 2,4-diaminophenols and methylaminophenols; ascorbic acid developing agents such as ascorbic acid, ascorbic acid ketals and ascorbic acid derivatives; hydroxylamine developing agents such as N,N-di(2-ethoxyethyl)hydroxylamine; pyrimidine developing agents; 3-pyrazolidone developing agents such as 1-phenyl-3-pyrazolidone and 4-methyl-4-hydroxymethyl-1-phenyl-3-pyrazolidone (referred to herein as R-1), such as described in British Patent No. 930,572 published July 3, 1963; hydroxytetronic acid and hydroxytetronimide developing agents; reductone developing agents, such as anhydrodihydropiperidino hexose reductone; and furanone developing agents such as 3,4-dihydroxy-5-phenyl-2,5-dihydro-2-furanone; and the like. Combinations of developing agents can be useful if desired.

The term "silver salt developing agent" as used herein is intended to also include developing agent precursors, that is, the term includes compounds, known as precursors, which form a developing agent, such as upon exposure to suitable energy, for example, light or heat.

A range of concentration of photographic silver salt developing agent can be useful in the described materials according to the invention. Typically, a concentration of photographic silver salt developing agent is used that is within the range of about 0.1 to about 2.0 moles of developing agent per mole of silver in the photographic material, preferably a concentration of developing agent that is within the range of 0.5 to 1.0 moles of developing agent per mole of silver in the photographic material. The optimum concentration of developing agent will depend upon a variety of factors including the particular photographic material, the particular photographic silver salt, the desired image, processing conditions and the like.

In a photographic material, as described, a useful concentration of activator precursor is typically within the range of about 0.2 to 4.0 moles of activator precursor per mole of total silver in the photographic material, preferably within the range of 0.5 to 2.0 moles of activator precursor per mole of total silver in the photographic material. The described developing agent is typically present in a concentration within the range of about 0.1 to 2.0 moles of developing agent per mole of silver, preferably within the range of about 0.5 to 1.0 moles of developing agent per mole of silver in the photographic material. The photographic silver salt, preferably photographic silver halide, is typically present in a concentration within the range of about 0.02 to about 0.3 millimoles per square decimeter of support of an element as described, preferably within the range of about 0.05 to 0.2 millimoles of photosensitive silver salt per square decimeter of support, as described. The optimum concentration of each of these components can be balanced depending upon the described factors, such as desired image, processing conditions, particular components of the photographic material and the like.

An especially useful embodiment of the invention is a heat developable and heat stabilizable photographic element comprising a support having thereon, in reactive association, (a) photographic silver halide, (b) a 3-pyrazolidone silver halide developing agent, as described, (c) a polymeric binder, typically a gelatino binder, and (d) an activating and stabilizing concentration of an activator-stabilizer precursor represented by the formula:

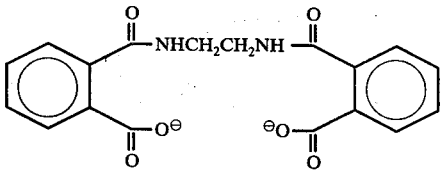

-continued

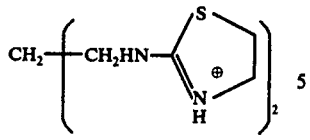

Another especially useful embodiment is a heat developable and heat stabilizable photographic element comprising a support having thereon, in reactive association, (a) a photographic silver halide, as described, especially a photographic silver bromoiodide, (b) an activating and stabilizing concentration of an activator-stabilizer precursor consisting essentially of 1,3-bis(2-amino-2-thiazolinyl) propane · N,N'-ethylenebis(phthalamic acid), (c) an auxiliary stabilizer precursor consisting essentially of 1,3-bis[2S-(N,N'-ethyleneisothiourea)ethyl]urea, (d) N,N-ethylenebis(phthalamic acid), (e) a silver halide developing agent consisting essentially of 4-hydroxymethyl-4-methyl-1-phenyl-3-pyrazolidone, and (f) a gelatino binder.

Another especially useful embodiment of the invention is a heat developable and heat stabilizable photographic element comprising a support having thereon in reactive association (a) photographic silver halide, especially photographic silver bromoiodide, (b) a development restrainer represented by the formula:

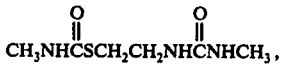

(c) a toning concentration of an image toner represented by the formula:

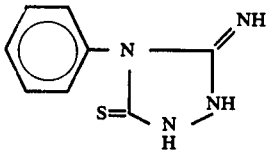

(d) an auxiliary activator-stabilizer precursor represented by the formula:

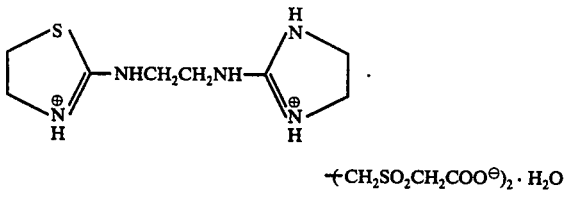

(e) an activating and stabilizing concentration of an activator-stabilizer precursor represented by the formula:

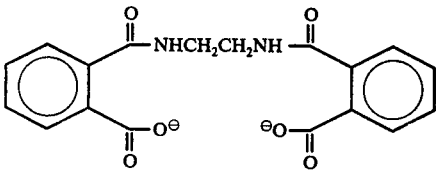

-continued

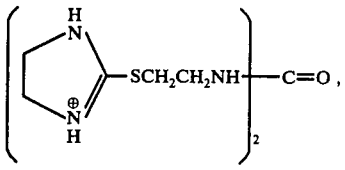

(f) a first silver halide developing agent consisting essentially of 2-(n-propyl)-4,5,6-trihydropyrimidine, (g) a second silver halide developing agent consisting essentially of 4-hydroxymethyl-4-methyl-1-phenyl-3-pyrazolidone (referred to herein as R-1), and (h) a polymeric binder, especially a gelatino binder.

As described, it is often useful to include an auxiliary stabilizer precursor in the described photographic material of the invention. Useful auxiliary stabilizer precursor compounds include, for example, those described in U.S. application Ser. No. 712,459 of Merkel and Ling, filed Aug. 6, 1976. These compounds include activator stabilizer precursors having an acid portion which is an alpha-sulfonylacetate. Especially useful auxiliary activator-stabilizer precursor compounds are those having a base portion which is a protonated basic nitrogen containing moiety and an acid portion that is an alpha-sulfonylacetate. Particularly useful alpha-sulfonylacetate compounds include those wherein the alpha-sulfonylacetate moiety is an ethylenebis(sulfonylacetate), methylenebis(sulfonylacetate) or phenylsulfonylacetate. An especially useful auxiliary activator stabilizer precursor is 1,3-bis[2S-(N,N'-ethyleneisothiourea)ethyl]urea · ethylenebis(sulfonylacetate) (this compound can also be named as $\beta,\beta'$-ureylenebis(2-ethylthio-2-imidazolinium)ethylenebis(sulfonylacetate). A range of concentration of auxiliary activator-stabilizer precursor can be useful in the described photographic materials according to the invention. A useful concentration of auxiliary activator-stabilizer precursor is typically within the range of about 0.1 to about 1.0 moles of auxiliary activator-stabilizer precursor compound per mole of silver in the described photographic material. The optimum concentration of auxiliary activator-stabilizer precursor compound can be determined based on a variety of factors including the desired image, particular components in the photographic material, the primary activator-stabilizer precursor, processing conditions and the like. Combinations of auxiliary activator-stabilizer precursors can be useful if desired.

It is useful in some instances to include a development restrainer in the described photographic materials according to the invention in order to provide improved image discrimination. A development restrainer, as described herein, is intended to mean a compound which reduces development on fog centers producing lower $D_{min}$ values. Useful development restrainers include, for example, 1-methyl-3-[2-(methylcarbamoylthio)ethyl]urea and bromide ion. A range of concentration of development restrainer can be useful in the described photographic material. Typically, a concentration of development restrainer is used, that is, within the range of about 0.01 to 0.2 moles of development restrainer per mole of silver in the photographic material. The optimum concentration of development restrainer can be determined based on a variety of factors, such as the particular photographic material, desired image, processing conditions, particular components of the photographic material and the like.

A photographic element, as described, can be prepared by coating the described materials on a suitable support to provide a heat developable photographic element. Any of the coating methods and means known in the photographic art can be useful for coating the described photographic materials on a suitable support. If desired, the described photographic element according to the invention can contain two or more layers. These layers, if desired, can be coated simultaneously using procedures known in the photographic art.

The silver halide photographic materials, as described, can be washed or unwashed to remove soluble salts after precipitation of the silver halide. The silver halide can be chemically sensitized; can contain development modifiers that function as speed-increasing compounds; and can contain antifoggants and emulsion stabilizers, as described in the *Product Licensing Index,* Volume 92, December 1971, publication 9232, published by Industrial Opportunities Ltd., Homewell, Havant, Hampshire, PO9 1EF, UK.

The photographic materials, as described, can also contain hardeners, antistatic layers, plasticizers, lubricants, coating aids, matting agents, brighteners, and absorbing and filter dyes which do not adversely affect the properties of the heat developable materials of the invention. These addenda are described, for example, in the above *Product Licensing Index* publication.

The heat developable photographic materials, as described, can contain a variety of vehicles and binders, alone or in combination. The photographic material typically contains a polymeric binder. The described activator precursors, especially the activator-stabilizer precursors, can be preformed as described or can be formed in situ, also as described, merely by mixing the acid and base portions in the presence of a solvent and a suitable vehicle. Suitable vehicle and binder materials include both naturally-occurring substances such as proteins, for example, gelatin, gelatin derivatives, cellulose derivatives, polysaccharides, such as dextran, and the like; and synthetic polymeric materials such as water soluble polyvinyl compounds like poly(vinyl pyrrolidone), acrylamide polymers and the like. The photographic layer and other layers of a photographic element, according to the invention, such as an overcoat layer, interlayer, subbing layer and the like can also contain, alone or in combination with the described vehicles, other synthetic polymeric vehicle compounds, such as dispersed vinyl compounds, such as in latex form, and particularly those which increase the dimensional stability of the photographic materials. Useful synthetic polymers include those described in the above *Product Licensing Index* publication. Effective polymeric binders include water insoluble polymers of alkylacrylates and methacrylates, acrylic acid, sulfoalkylacrylates or methacrylates and those which have crosslinking sites which facilitate hardening or curing as well as those having recurring sulfobetaine units as described in Canadian Patent No. 774,054 issued Dec. 19, 1967. Especially effective polymeric binders are those which can withstand processing temperatures above about 250° C.

The photographic and other layers of a photographic element, as described, can be coated on a variety of supports. It is necessary that the support be able to withstand the described processing temperatures without adversely affecting the described desired properties of the photographic material. Typical supports include those which can withstand processing temperatures above about 250° C. Useful supports include, for example, cellulose ester film, poly(vinyl acetal) film, poly(ethylene terephthalate) film, polycarbonate film and related films and resinous materials as well as glass, paper, metal and the like. Typically a flexible support is employed, especially a paper support.

The photographic materials of the invention can contain spectral sensitizing dyes to confer additional sensitivity to the light-sensitive silver salts, especially light-sensitive silver halide as described. Useful spectral sensitizing dyes are described, for example, in the above *Product Licensing Index* publication. Combinations of spectral sensitizing dyes can be useful if desired. In addition, supersensitizing addenda which do not absorb visible light can be useful in the described materials.

The spectral sensitizing dyes and other addenda useful in photographic materials according to the invention can be incorporated into these materials from aqueous compositions, such as water solutions, or suitable organic solvent compositions, such as organic solvent solutions. The sensitizing dyes and other addenda can be added using a variety of procedures known in the photographic art, such as described in the above *Product Licensing Index* publication.

The described activator precursors, especially activator-stabilizer precursors, are useful in a variety of physical locations in a photographic element according to the invention. The 2-carboxycarboxamide compounds are useful in one or more layers of the desired photographic element, such as in the silver halide containing layer and/or an overcoat layer and/or a layer between the silver salt containing layer and a support. It is necessary that the described 2-carboxycarboxamide compounds be contiguous to the photographic silver salt and developing agent to be activated. This contiguous location enables desired interaction between the photographic silver salt, especially photographic silver halide, and the developing agent or developing agent precursor upon heating of the photographic material. The term "in reactive association" as described herein is intended to mean that the described compounds are in such a location enabling the desired interaction.

A variety of saccharides can be useful in combination with the described 2-carboxycarboxamide compounds as they may provide a more fluid processing melt. Useful saccharides are described, for example, in British Patent No. 930,572 published July 3, 1963. The concentraton of saccharide that is useful will depend upon a variety of factors including the desired image, other components of the photographic material, the particular 2-carboxycarboxamide compound, processing conditions and the like. A concentration of about 0.01 to about 20 moles of saccharide per mole of the desired 2-carboxycarboxamide compound is typically useful.

The 2-carboxycarboxamide compounds are useful in a variety of heat developable photographic compositions especially heat developable and heat stabilizable photographic compositions. Accordingly, another embodiment of the invention is a heat developable and heat stabilizable photographic composition comprising (a) a photographic silver salt, especially photographic silver halide, (b) a photographic silver salt developing agent, as described, (c) a binder, preferably a polymeric binder, and (d) an activating concentration, preferably an activating and stabilizing concentration, of an activator precursor, preferably an activator-stabilizer precursor, having a base portion and an acid portion wherein the acid portion is a 2-carboxycarboxamide as described.

The described 2-carboxycarboxamide compounds are also useful in heat activatable, photographic silver salt processing compositions such as heat activatable silver halide developers, stabilizing compositions, fixing compositions, hardeners and the like which enable use of the alkali or base release and/or stabilizer release properties of the compounds. For these reasons, another embodiment of the invention is a heat activatable, photographic silver salt processing composition comprising a silver salt developing agent and an activator-stabilizer precursor having a base portion and an acid portion wherein the acid portion is a 2-carboxycarboxamide, as described. An example of a heat activatable photographic silver salt processing composition comprises a 3-pyrazolidone silver halide developing agent and an activator-stabilizing precursor consisting essentially of 1,3-bis(2-amino-2-thiazolinyl)propane · N,N'-ethylenebis(phthalamic acid). The activator precursor, especially the activator-stabilizer precursor, should be present in a concentration sufficient to stabilize the silver salt to be processed when the processing composition is heated. The concentration of activator precursor, particularly activator-stabilizer precursor, most useful will depend upon several factors such as the particular 2-carboxycarboxamide compound, processing temperature, desired image, the particular processing composition and the like. A useful concentration is typically within the range of about 0.2 mole to about 4 moles of the 2-carboxycarboxamide compound per mole of silver salt processing agent, especially silver salt developing agent, in the photographic silver salt processing composition.

Another example of a heat activatable, photographic silver salt processing composition is one comprising (a) a pyrimidine silver halide developing agent, (b) a 4-methyl-4-hydroxymethyl-1-phenyl-3-pyrazolidone silver halide developing agent and (c) an activating concentration of an activator-stabilizer precursor consisting essentially of 1,3-bis(2-amino-2-thiazolinyl)propane · N,N'-ethylenebis(phthalamic acid).

The processing composition which is heat activatable can also contain a binder as described, such as an ethyl cellulose binder.

Because the described 2-carboxycarboxamide activator-stabilizer precursors are useful as activator precursors for developing agents and as stabilizer precursors, no other stabilizers or stabilizer precursors are needed in the described materials of the invention. However, other stabilizers or stabilizer precursors can be useful with the photographic materials and process of the invention, if desired. For example, certain stabilizer precursors which form a stable silver complex upon heating in the described elements can be useful in combination with the 2-carboxycarboxamides described herein. Examples of useful stabilizers or stabilizer precursors which form a stable silver complex upon heating in the described element are certain isothiuronium compounds such as described in U.S. Pat. No. 3,669,670 of Haist and Humphlett, issued June 13, 1972. Halogen containing stabilizer precursors, such as tetrabromobutane or 2-tribromomethylsulfonylbenzothiazole, can also be useful in combination with the described 2-carboxycarboxamide compounds.

After exposure of a photographic material according to the invention to provide a developable image in the photographic material, the resulting image can be developed and, if desired, stabilized, by merely heating the element to a temperature within the range of about 120° C to about 200° C, usually within the range of about 150° C to about 180° C, until the desired image is developed. In the case of a photographic material containing the described activator-stabilizer precursor, the element can be heated until the desired image is developed and stabilized. An image is typically developed by heating the described material to the described temperature for about 1 to about 60 seconds, such as about 1 to about 30 seconds. By increasing or decreasing the time of heating, a higher or lower temperature within the described range is useful.

A variety of imagewise exposure means and energy sources can be useful for providing a latent image in the described photographic material before heating. The exposure means can be, for example, a light source, a laser, an electron beam, X-rays and the like.

Processing is typically carried out under ambient conditions of pressure and humidity. Pressures and humidity outside normal atmospheric conditions can be useful, if desired; however, normal atmospheric conditions are preferred.

A variety of means is useful for providing the necessary heating, as described. The photographic element, according to the invention, can be brought into contact with a simple hot plate, heated iron, rollers, dielectric heating means or the like.

Small concentrations of moisture can be present, and, in some instances, very helpful during processing. For instance, the concentrations of moisture present in conventional photographic paper supports at atmospheric conditions such as at about 25° C and 40% relative humidity in addition to the water that is released upon heating from the 2-carboxycarboxamide compound can be useful.

While it is not necessary, a development activator, also known as an alkali-release agent, base-release agent or an activator precursor, can be useful with the described 2-carboxycarboxamide compounds. A development activator, as described herein, is intended to mean an agent or compound which aids the developing agent at processing temperatures with the described 2-carboxycarboxamide compounds to develop a latent image in a photographic silver salt contiguous to the developing agent. Useful development activators or activator precursors are described, for example, in Belgian Patent No. 709,967 published Feb. 29, 1968. Examples of useful activator precursors include guanidinium compounds, such as guanidinium trichloroacetate, diguanidinium glutarate, succinate, malonate and the like; quaternary ammonium malonates such as piperizinium or piperidinium malonate; amino acids; such as 6-aminocaproic acid and glycine; and the like. Other activator precursors are described, for example, in British Patent No. 998,949 published July 21, 1965.

The described 2-carboxycarboxamides can be useful in light-sensitive diazotype materials. The two components of light-sensitive diazotype materials can contain at least one light-sensitive diazonium salt and at least one coupling compound which can react with the diazonium salt, typically in an alkaline medium to form an azo dye. In addition, a variety of other addenda such as ultraviolet absorbers, acid stabilizers (to prevent premature coupling of the diazonium salt and the coupler), can be present with the 2-carboxycarboxamide compounds as described. A diazotype element containing the described 2-carboxycarboxamides can be imagewise exposed to activating radiation through an original. The light exposure decomposes the diazonium salt. Thereafter, development of the exposed diazotype material can be accomplished by treatment with an alkaline medium. In lieu of externally supplied alkali, such as provided by ammonia, the described 2-carboxycarboxamide compounds can be useful when incorporated in the diazotype materials as alkaline releasing development precursors. The 2-carboxycarboxamide compounds, as described, when heated such as to a temperature within the range of about 120° C to about 200° C generate base useful for initiating a coupling reaction in the diazotype material. Simple heating produces desired image development without requiring an outside source of ammonia or other base material. An example of a diazotype material containing a 2-carboxycarboxamide, as described, comprises a water soluble cellulose acetate binder, cyclohexylsulfonic acid, paradiazodiethylaniline zinc chloride, 6,7-dihydroxy-2-naphthalene sodium sulfonate, a surfactant, and a compound which is a 2-carboxycarboxamide, as described, such as 1,3-bis(2-amino-2-thiazolinyl)propane · N,N'-ethylenebis(phthalamic acid). This material is coated on a suitable support, such as a polyester film support at a desired wet coating thickness. After drying, the resulting diazotype photographic material can be exposed imagewise to ultraviolet radiation until the diazonium salt is decomposed in the imagewise exposed areas. The exposed element can then be heated to a temperature within the range of about 150° to about 200° C for a period of time sufficient to provide a developed dye image, typically about 2 to about 30 seconds.

The following examples are included for a further understanding of the invention.

EXAMPLE 1

Use of 1,3-bis(2-amino-2-thiazolinyl)propane · N,N-ethylenebis(phthalamic acid) in a heat developable photographic material according to the invention The following composition was mixed and then coated from water on a 4 mil, gel subbed, poly(ethylene terephthalate) film support:

| | |
|---|---|
| gelatin | 27.0 mg/dm$^2$ (250 mg/ft$^2$) |
| Surfactant (Surfactant 10G which is a nonylphenoxypolyglycidol available from Olin Corp., U.S.A.) | 1.1 mg/dm$^2$ (10 mg/ft$^2$) |
| 4-hydroxymethyl-4-methyl-1-phenyl-3-pyrazolidone (developing agent R-1) | 14.0 mg/dm$^2$ (130 mg/ft$^2$) |
| N,N'-ethylenebis(phthalamic acid) (referred to herein as Compound C) | 22.7 mg/dm$^2$ (210 mg/ft$^2$) |
| 1,3-bis[2S-(N,N'-ethyleneisothiourea) ethyl]urea (referred to herein as Compound D) | 16.2 mg/dm$^2$ (150 mg/ft$^2$) |
| 1,3-bis(2-amino-2-thiazolinyl)propane N,N'-ethylenebis(phthalamic acid) $2CH_3OH$ | 42.6 mg/dm$^2$ (395 mg/ft$^2$) |
| photographic silver bromoidoide (unsensitized silver bromoiodide having an average grain size of 0.12 microns) | 14.0 mgAg/dm$^2$ (130 mgAg/ft$^2$) |

The resulting coating was permitted to dry at 43° C to provide a heat developable photographic material according to the invention. (The pH of the composition prior to coating was adjusted to 4.5 with one normal nitric acid). The heat developable photographic element was overcoated with 50 mg/ft$^2$ (5.4 mg/dm$^2$) of polymethylmethacrylate (available as Elvacite 2009 which is a trade name of E. I. DuPont Demours Co., U.S.A.). The polymethylmethacrylate was coated from dichloromethane to provide increased resistance to abrasion and other markings upon processing. The heat developable photographic element was then sensitometrically exposed to white light to provide a developable latent image. The latent image was then developed by contacting the photographic element with a metal block for 25 seconds at 160° C. A developed image was produced having a purple tone. The developed image was light stable and had a maximum diffuse density of 1.7 and a minimum diffuse density of 0.1.

The above procedure was repeated with the exception that prior to imagewise exposure, the photographic element was incubated for 2 weeks at 38° C and 50% relative humidity. The photographic element after imagewise exposure and processing provided a developed image having a maximum diffuse density of 1.6 and a minimum diffuse density of 0.1. The developed images in each case were free of "pinholes".

EXAMPLE 2

Comparative example

This is a comparative example using an α-sulfonylacetic acid compound in place of the 2-carboxycarboxamide compound of Example 1.

The following composition was mixed and then coated from water on a poly(ethylene terephthalate) film support as in Example 1. This composition was identical to that of Example 1 except that the phthalamic acid compounds described in Example 1 were replaced with the sulfonylacetic acid compound described below:

| | |
|---|---|
| gelatin | 27.0 mg/dm$^2$ (250 mg/ft$^2$) |
| Surfactant 10G | 1.1 mg/dm$^2$ (10 mg/ft$^2$) |
| R-1 (developing agent) | 14.0 mg/dm$^2$ (130 mg/ft$^2$) |
| ethylenebis(sulfonylacetic acid) | 17.8 mg/dm$^2$ (165 mg/ft$^2$) |
| Compound D (described in Example 1) | 16.2 mg/dm$^2$ (150 mg/ft$^2$) |
| 1,3-bis(2-amino-2-thiazolinyl) propane . ethylenebis(sulfonyl-acetate acid) | 33.5 mg/dm$^2$ (310 mg/ft$^2$) |
| photographic silver bromoidoide (as described in Example 1) | 14.0 mgAg/dm$^2$ (130 mgAg/ft$^2$) |

The resulting coating was permitted to dry as described in Example 1 and then the photographic element was overcoated with 50 mg/ft$^2$ (5.4 mg/dm$^2$) of polymethylmethacrylate as described in Example 1.

The heat developable photographic element was imagewise exposed to provide a developable latent image and then heated for 15 seconds at 160° C to develop the latent image. The resulting developed image was light stable and had a maximum diffuse density of 2.2 and a minimum diffuse density of 0.1.

The procedure was repeated with the exception that prior to imagewise exposure and processing, the photographic element was incubated for 2 weeks at 38° C and 50% relative humidity. The resulting developed image had a maximum diffuse density of 2.0 and a minimum diffuse density of 0.1. Unlike the photographic element of Example 1, the photographic element of Example 2 contained undesirable numbers of pinholes. These were produced by bubbles of carbon dioxide released during processing. The pinholes obscured or obliterated valuable information in the photographic element.

EXAMPLE 3

Use of higher speed photographic silver halide

The following composition was mixed and then coated from water on a poly(ethylene terephthalate) film support and after drying was overcoated with 50 mg/ft$^2$ (5.4 mg/dm$^2$ of polymethylmethacrylate:

| | |
|---|---|
| gelatin | 27.0 mg/dm$^2$ (250 mg/ft$^2$) |
| Surfactant 10G | 1.1 mg/dm$^2$ 10 mg/ft$^2$) |
| R-1 (developing agent) | 14.0 mg/dm$^2$ (130 mg/ft$^2$) |
| Compound C | 45.9 mg/dm$^2$ (425 mg/ft$^2$) |
| Compound D | 20.5 mg/dm$^2$ (190 mg/ft$^2$) |
| Compound F represented by the formula | 19.4 mg/dm$^2$ (180 mg/ft$^2$) |
| $\left(CH_3-\overset{CH_3}{\overset{\vert}{N}}-CH_2CH_2CH_2-NH-\overset{O}{\overset{\Vert}{C}}-NH-CH_2CH_2CH_2\right)_2$ | |
| silver bromoidodie emulsion chemically sensitized with sulfur and gold (silver bromo-iodide gelatino emulsion having an average gr ain size of 0.1 microns) | 14.0 mgAg/dm (130 mgAg/ft$^2$) |

The pH of the resulting composition was adjusted to 4.5 with one normal nitric acid.

The resulting photographic element was imagewise exposed, as described in Example 1, to provide a developable latent image. It was then heated for 30 seconds at 160° C to provide a developed image. A similar photographic element, that was imagewise exposed in the same manner and then heated for 10 seconds at 180° C, also provided a developed image. The developed image in each instance had a diffuse maximum density of 1.7 and a diffuse minimum density of 0.1.

The procedure was repeated with the imagewise exposure being provided with a blue light to determine the minimum energy level required to produce a density of 1.0 in the developed image. It was found that a blue light energy of only 4 ergs/cm$^2$ was required to produce such a density.

The procedure was repeated with the exception that the photographic element was incubated for 1 week at 38° C and 50% relative humidity prior to the described imagewise exposure. The resulting developed image had a maximum density of 1.7 and a minimum density of 0.15. The photographic speed of the material remained essentially unchanged. Specular maximum density of the resulting developed material was 1.9 with a specular minimum density of 0.18.

EXAMPLE 4

Use of another 2-carboxycarboxamide compound

The composition described below was mixed and then coated from water onto a poly(ethylene terephthalate) film support, permitted to dry at 43° C, and then overcoated with 50 mg/ft$^2$ (5.4 mg/dm$^2$) of polymethylmethacrylate as described in Example 1:

| | |
|---|---|
| gelatin | 21.6 mg/dm (200 mg/ft$^2$) |
| Surfactant 10G | 1.1 mg/dm$^2$ (10 mg/ft$^2$) |
| R-1 (developing agent) | 14.0 mg/dm$^2$ (130 mg/ft$^2$) |
| N,N'-hexamethylenebis(succinamic acid) | 27.0 mg/dm$^2$ (250 mg/ft$^2$) |
| Compound D | 24.8 mg/dm$^2$ (230 mg/ft$^2$) |
| 1,4-bis(2-a,omp-2-thiazolinyl) butane . N,N'-hexamethylenebis (succinamic acid) represented by the formula: | 22.2 mg/dm$^2$ (205 mg/ft$^2$) |
| 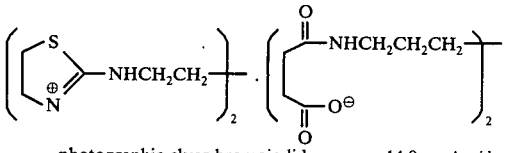 | |
| photographic slver bromoiodide (described in Example 1) | 14.0 mgAg/dm$^2$ (130 mgAg/ft$^2$) |

The resulting photographic element was imagewise exposed to light to provide a developable latent image. The resulting image was developed by heating the element at 160° C for 20 seconds. A developed image was provided having a diffuse maximum density of 1.7 and a diffuse minimum density of 0.06.

The procedure as described was repeated with the exception that the photographic element was incubated as described in Example 2. The incubation stability results of this test indicated that the element of Example 4 was inferior to that of Example 1.

EXAMPLE 5

Use of a combination of a 2-carboxycarboxamide compound with a different α-sulfonylacetic acid compound The following composition was mixed and then coated from water onto a polyethylene coated paper support containing a layer of poly(acrylamide-co-1-vinylimidazole) (weight ratio 90:10) on the polyethylene:

| | |
|---|---|
| gelatin | 21.6 mg/dm$^2$ (200 mg/ft$^2$) |
| Surfactant 10G | 1.1 mg/dm$^2$ (10 mg/ft$^2$) |
| R-1 (developing agent) | 2.2 mg/dm$^2$ (20 mg/ft$^2$) |
| 2-(n-propyl)-4,5,6-trihydroxy-pyrimidine (auxiliary developing agent) | 5.4 mg/dm$^2$ (50 mg/ft$^2$) |
| Compound C | 17.3 mg/dm$^2$ (160 mg/ft$^2$) |
| Compound D | 12.4 mg/dm$^2$ (150 mg/ft$^2$) |
| α-sulfonylacetate compound represented by the formula: | 24.3 mg/dm$^2$ (225 mg/ft$^2$) |

-continued

| | |
|---|---|
| 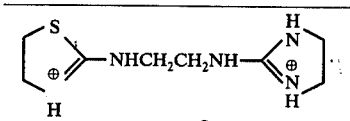 $(CH_2SO_2CH_2CO_2^{\ominus})_2 \cdot H_2O$ | |
| image toner represented by the formula: 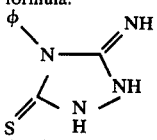 | 0.1 mg/dm$^2$ (1 mg/ft$^2$) |
| development restrainer represented by the formula: $CH_3NH-\overset{O}{\overset{\|}{C}}-SCH_2CH_2NH-\overset{O}{\overset{\|}{C}}-NHCH_3$ | 0.2 mg/dm$^2$ (2 mg/ft$^2$) |
| photographic silver bromoiodide (unsensitized silver bromoiodide having an average grain size of 0.09 microns) | 8.6 mgAg/dm$^2$ (80 mgAg/ft$^2$) |

The pH of the composition was adjusted prior to coating to 4.5 with one normal nitric acid. The resulting photographic element was overcoated with 50 mg/ft$^2$ (5.4 mg/dm$^2$) of polymethylmethacrylate as described in Example 1.

The photographic element was imagewise exposed to light to provide a developable latent image and then heated for 30 seconds at 160° to provide a developed image. The procedure was repeated with the exception that the photographic element after imagewise exposure was heated for 10 seconds at 180° C. In each instance the developed image was nearly neutral (black) and was light stable. The maximum reflection density of the developed image was 1.4 and the minimum reflection density was 0.1. The photographic element after processing was free from "pinholes" even at a processing temperature of 180° C.

If the Compound C in the above composition is replaced with ethylenebis(sulfonylacetic) acid, undesired pinholes are formed at 180° C.

Other 2-carboxycarboxamides were incorporated in a photographic element similar to that described in Example 1.

EXAMPLE 6

The procedure described in Example 1 was repeated with the exception that the 2-carboxycarboxamide represented by the formula:

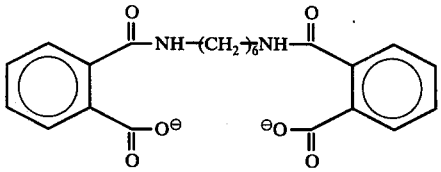

was used in place of the 2-carboxycarboxamide of Example 1.

The resulting developed image had a maximum density of 1.4 and a minimum density of 0.08 upon heating the imagewise exposed element for 30 seconds at 160° C.

EXAMPLE 7

A procedure similar to that described in Example 6 was repeated with the exception that the following 2-carboxycarboxamide compound was used in place of the 2-carboxycarboxamide compound of Example 6:

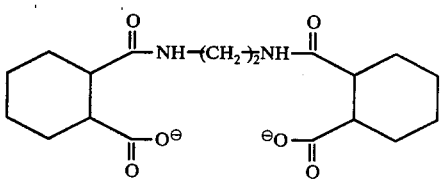

A developed image was produced. While an image was provided, it was determined that the pKa of this 2-carboxycarboxamide is undesirably high to provide the desired incubation stability.

EXAMPLE 8

A procedure similar to that described in Example 6 was repeated with the exception that the 2-carboxycarboxamide compound was replaced with the following 2-carboxycarboxamide compound:

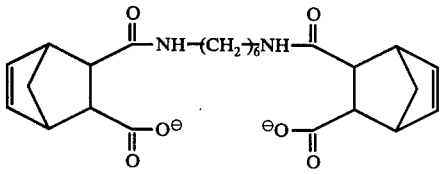

The photographic element according to this example contained a stabilizer precursor represented by the formula:

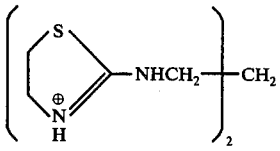

The photographic element was imagewise exposed to provide a developable latent image as described in Example 1. The resulting image was developed by heating the element for 20 seconds at 160° C. This provided a developed light-stable image. The maximum density of the developed image was undesirably low and the image was high in fog. The photographic element demonstrated poor keeping properties also.

EXAMPLE 9

A procedure similar to that described in Example 6 was repeated in which the following 2-carboxycarboxamide compound was used in place of the 2-carboxycarboxamide compound of Example 6:

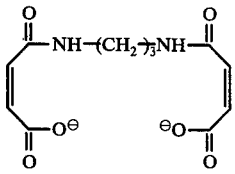

The above 2-carboxycarboxamide compound was incorporated in the photographic layer as an aminothiazoline derivative. The resulting photographic element was imagewise exposed and processed as described in Example 1 to provide a developed image having a maximum density of 0.8 and a minimum density of 0.04.

EXAMPLE 10

The procedure described in Example 6 was repeated with the exception that the following 2-carboxycarboxamide compound was used in place of the 2-carboxycarboxamide compound of Example 6:

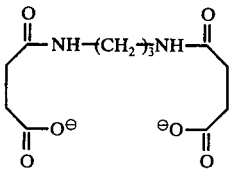

The photographic element according to this example contained a combination of stabilizers consisting of Compounds D and F. The photographic element was imagewise exposed to provide the developable latent image as described in Example 1, then heated for 30 seconds at 160° C. The resulting developed image had a maximum density of 2.0 and a minimum density of 0.12 (the composition contained about 10 mgAg/dm$^2$).

The photographic element of this example demonstrated less than desired keeping properties upon incubation.

EXAMPLE 11

This is a comparative example. The following compound was prepared and tested thermoanalytically:

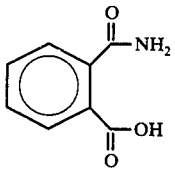

The resulting data demonstrated that the cyclization product of the above compound was undesirably volatile and that the compound also had a pKa which was undesirably high.

EXAMPLE 12

This is a comparative example. The following compound was prepared and tested thermoanalytically:

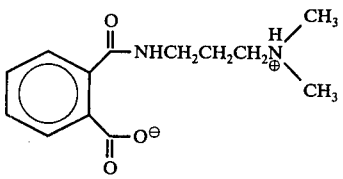

The resulting data demonstrated that the above compound provided a cyclization product which was undesirably volatile.

The invention has been described in detail with particular reference to preferred embodiments thereof, but it will be understood that variations and modifications can be effected within the spirit and scope of the invention.

What is claimed is:

1. In a heat developable, photographic element comprising a support having thereon (a) a photographic silver salt, (b) a photographic silver salt developing agent, (c) a binder, and (d) an activating concentration of an activator precursor having a base portion and an acid portion; said (d) being contiguous to (a) and (b); the improvement wherein said acid portion is a 2-carboxycarboxamide.

2. A heat developable and heat stabilizable photographic element as in claim 1 wherein said base portion is an amine or isothiuronium moiety having a pKa value within the range of 8 to 12 and wherein said 2-carboxycarboxamide undergoes less than 10% weight loss, except loss due to water release, in a thermogravimetric scan between about 30° and about 180° C where the scan rate is about 40° C per minute.

3. A heat developable photographic element as in claim 1 wherein said activator precursor is an activator-stabilizer precursor containing an N,N'-ethylenebis(phthalamic acid moiety.

4. A heat developable photographic element as in claim 1 wherein said activator precursor is an activator-stabilizer precursor consisting essentially of 1,3-bis(2-amino-2-thiazolinyl)propane · N,N'-ethylenebis(phthalamic acid).

5. A heat developable photographic element as in claim 1 wherein said photographic silver salt is photographic silver halide.

6. The heat developable photographic element as in claim 1 wherein said activating concentration is within the range of 2.0 to 4 moles of said activator-precursor per mole of photographic silver salt.

7. A heat developable and heat stabilizable photographic element comprising a support having thereon a layer comprising (a) photographic silver halide, (b) a 3-pyrazolidone silver halide developing agent, (c) a polymeric binder, and (d) an activating and stabilizing concentration of an activator-stabilizer precursor represented by the formula:

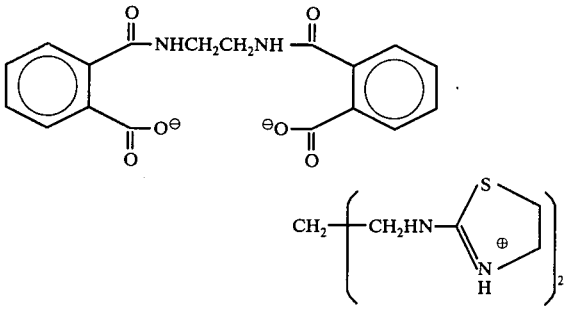

8. A heat developable and heat stabilizable photographic element comprising a support having thereon a layer comprising (a) a photographic silver bromoiodide, (b) an activating and stabilizing concentration of an activator-stabilizer precursor consisting essentially of 1,3-bis(2-amino-2-thiazolinyl)propane · N,N'-ethylenebis-(phthalamic acid), (c) an auxiliary stabilizer precursor consisting essentially of 1,3-bis[2S-(N,N-ethyleneisothiourea)ethyl]urea, (d) N,N-ethylenebis(phthalamic acid), (e) a silver halide developing agent consisting essentially of 4-hydroxymethyl-4-methyl-1-phenyl-3-pyrazolidone, and (f) a gelatino binder.

9. A heat developable and heat stabilizable photographic element comprising a support having thereon a layer comprising (a) photographic silver bromoiodide, (b) a development restrainer represented by the formula:

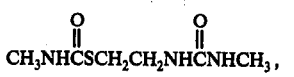

(c) a toning concentration of an image toner represented by the formula:

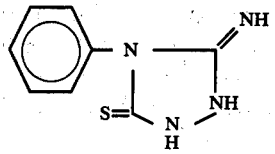

(d) an auxiliary activator-stabilizer precursor represented by the formula:

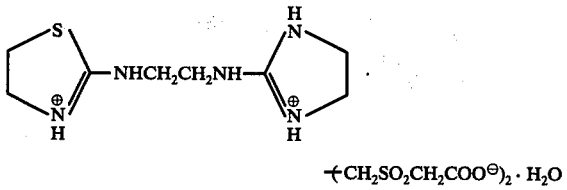

(e) an activating and stabilizing concentration of an activator-stabilizer precursor represented by the formula:

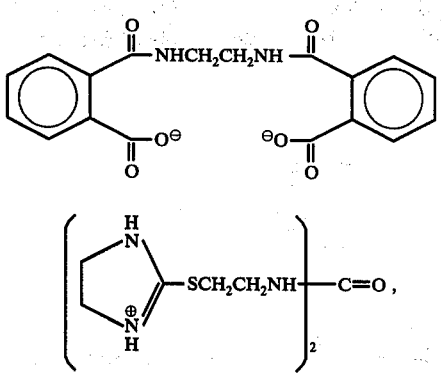

(f) a first silver halide developing agent consisting essentially of 2-(n-propyl)-4,5,6-trihydropyrimidine, (g) a second silver halide developing agent consisting essentially of 4-hydroxymethyl-4-methyl-1-phenyl-3-pyrazolidone, and (h) a gelatino binder.

10. In a heat developable, photographic composition comprising (a) a photographic silver salt, (b) a photographic silver salt developing agent, (c) a binder, and (d) an activating concentration of an activator precursor having a base portion and an acid portion, the improvement wherein said acid portion is a 2-carboxycarboxamide.

11. A heat developable photographic composition as in claim 10 wherein said activator precursor is an activator-stabilizer precursor containing an N,N'-ethylenebis(phthalamic acid) moiety.

12. A heat developable photographic composition as in claim 10 wherein said activator precursor is an activator-stabilizer precursor consisting essentially of 1,3-bis(2-amino-2-thiazolinyl)propane · N,N'-ethylenebis(phthalamic acid).

13. A heat developable composition as in claim 10 wherein said photographic silver salt is photographic silver halide.

14. A heat developable photographic composition as in claim 10 wherein said activating concentration is within the range of 0.2 to 4 moles of said activator-precursor per mole of photographic silver salt.

15. A heat developable and heat stabilizable photographic composition comprising (a) a photographic silver halide, (b) a 3-pyrazolidone silver halide developing agent, (c) a polymeric binder, and (d) a stabilizing concentration of an activator-stabilizer precursor represented by the formula:

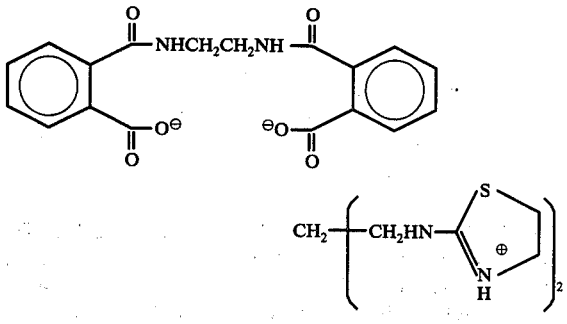

16. A heat developable and heat stabilizable composition comprising (a) a photographic silver bromoiodide, (b) an activating and stabilizing concentration of an activator-stabilizer precursor consisting essentially of 1,3-bis(2-amino-2-thiazolinyl)propane · N,N'-ethylenebis(phthalamic acid), (c) an auxiliary stabilizer precursor consisting essentially of 1,3-bis[2S-(N,N'-ethyleneisothiourea)ethyl]urea, (d) N,N-ethylenebis(phthalmic acid), (e) a silver halide developing agent consisting essentially of 4-hydroxymethyl-4-methyl-1-phenyl-3-pyrazolidone, and (f) a gelatino binder.

17. A heat developable and heat stabilizable photographic composition comprising (a) photographic silver bromoiodide, (b) a development restrainer represented by the formula:

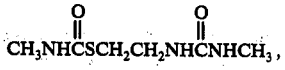

(c) a toning concentration of an image toner represented by the formula:

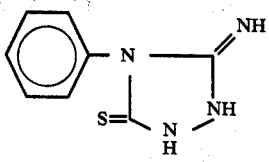

(d) an auxiliary activator-stabilizer precursor represented by the formula:

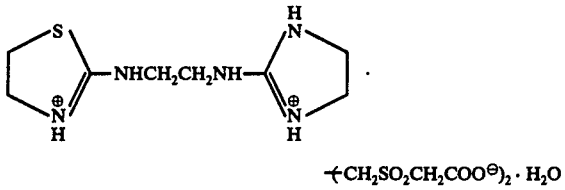

(e) an activating and stabilizing concentration of an activator-stabilizer precursor represented by the formula:

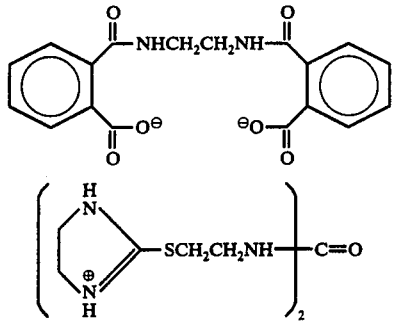

(f) a first silver halide developing agent consisting essentially of 2-(n-propyl)-4,5,6-trihydropyrimidine, (g) a second silver halide developing agent consisting essentially of 4-hydroxymethyl-4-methyl-1-phenyl-3-pyrazolidone, and (h) a gelatino binder.

18. A heat developable and heat stabilizable photographic element comprising a support having thereon (a) a photographic silver salt, (b) a photographic silver salt developing agent, (c) a binder and (d) an activating and stabilizing concentration of an activator-stabilizer precursor, said precursor being a 2-carboxycarboxamide represented by the formula:

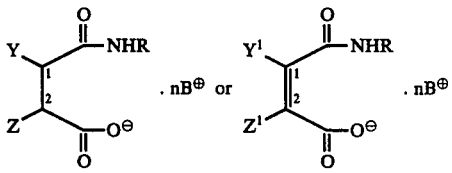

wherein B is a basic protonated nitrogen containing moiety;

$n$ is 1 or 2 and is an integer sufficient to form a neutral compound;

Y, Z, $Y^1$ and $Z^1$ are independently selected from the group consisting of hydrogen and alkyl containing 1 to 4 carbon atoms or $Y^1$ and $Z^1$ together represent the atoms necessary to complete a phenylene group;

R is selected from the group consisting of hydrogen, alkyl containing 1 to 10 carbon atoms,

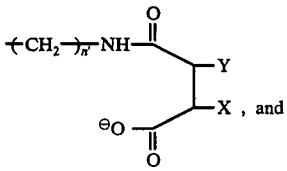

-continued

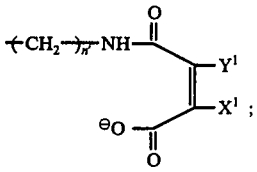

wherein $n'$ is 1 to 6; and X is the same as Z and $X^1$ is the same as $Z^1$; said (d) being contiguous to (a) and (b).

19. A heat developable and heat stabilizable photographic element as in claim 18 wherein B is an amine or isothiuronium moiety having a pKa value within the range of 8 to 12 and is selected from the group represented by the formulas:

I.

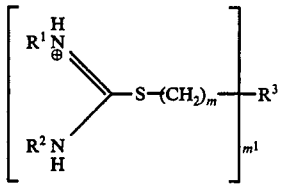

wherein $m$ is 2 to 6;

$m^1$ is 1 or 2;

$R^1$ and $R^2$ are independently selected from the group consisting of hydrogen and alkyl containing 1 to 5 carbon atoms, or are the carbon atoms necessary to complete a five or six member heterocyclic nucleus;

II.

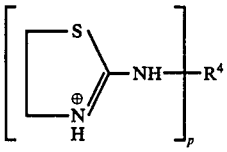

wherein $p$ is 1 or 2;

$R^4$, when $p$ is 1, is selected from the group consisting of hydrogen and alkyl containing 1 to 3 carbon atoms;

$R^4$, when $p$ is 2, is alkylene containing 1 to 6 carbon atoms.

20. A heat developable photographic element comprising a support having thereon a layer comprising (a) a photographic silver salt, (b) a photographic silver salt developing agent, (c) a binder, and (d) an activating concentration of an activator precursor having a pKa within the range of 8 to 12 and represented by the formula:

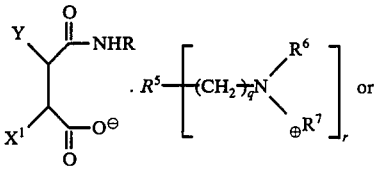

-continued

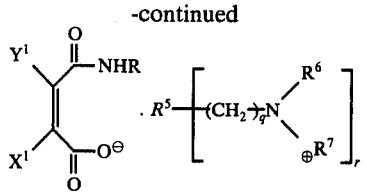

wherein Y, X, $Y^1$ and $X^1$ are independently selected from the group consisting of hydrogen and alkyl containing 1 to 4 carbon atoms or $Y^1$ and $X^1$ together represent the atoms necessary to complete a phenylene group;

R is selected from the group consisting of hydrogen, alkyl containing 1 to 10 carbon atoms,

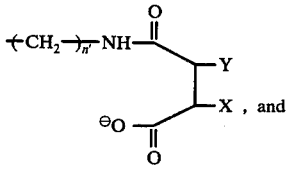

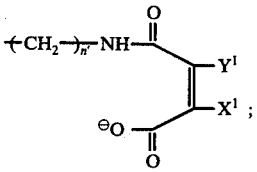

$n'$ is 1 to 6;

$q$ is 1 to 6;

$r$ is 1 or 2 and is an integer sufficient to form a neutral compound;

$R^6$ and $R^7$ are each selected from the group consisting of hydrogen and alkyl containing 1 to 4 carbon atoms;

$R^5$, when $r$ is 2, is selected from the group consisting of

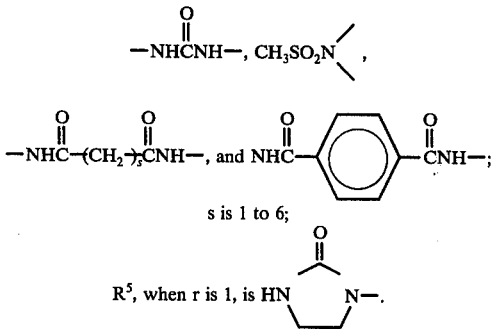

s is 1 to 6;

$R^5$, when r is 1, is HN N—.

21. The heat developable photographic element of claim 20 wherein said activator precursor undergoes less than 10% weight loss, except loss due to water release, in a thermogravimetric scan between about 30° C and about 180° C where the scan rate is about 40° C per minute.

22. A heat developable and heat stabilizable composition comprising (a) a photographic silver salt, (b) a photographic silver salt developing agent, (c) a binder and (d) an activating and stabilizing concentration of an activator-stabilizer precursor that is a 2-carboxycarboxamide represented by the formula:

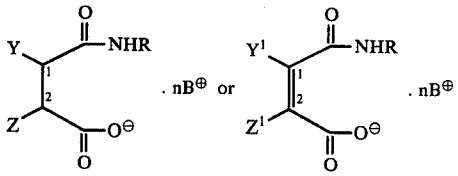

wherein B is a basic protonated nitrogen containing moiety;

$n$ is 1 or 2 and is an integer sufficient to form a neutral compound;

Y, Z, $Y^1$ and $Z^1$ are individually selected from the group consisting of hydrogen and alkyl containing 1 to 4 carbon atoms or $Y^1$ and $Z^1$ together represent the atoms necessary to complete a phenylene group;

R is selected from the group consisting of hydrogen, alkyl containing 1 to 10 carbon atoms,

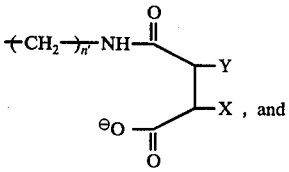

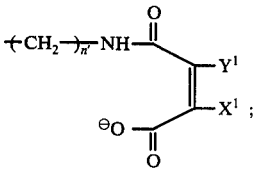

wherein $n'$ is 1 to 6; X is the same as Z and $X^1$ is the same as $Z^1$.

23. A heat developable and heat stabilizable composition as in claim 22 wherein B is an amine or isothiuronium moiety having a pKa value within the range of 8 to 12 and is selected from the group represented by the formulas:

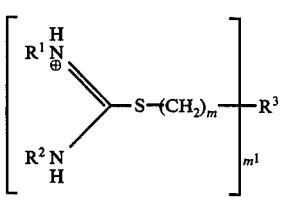

I.

wherein $m$ is 2 to 6;

$m^1$ is 1 or 2 and is an integer sufficient to form a neutral compound;

$R^1$ and $R^2$ are independently selected from the group consisting of hydrogen and alkyl containing 1 to 5 carbon atoms, or are the carbon atoms necessary to complete a five or six member heterocyclic nucleus;

II.

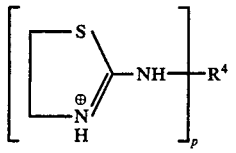

wherein $p$ is 1 or 2 and is an integer sufficient to form a neutral compound;

$R^4$, when $p$ is 1, is selected from the group consisting of hydrogen and alkyl containing 1 to 3 carbon atoms;

$R^4$, when $p$ is 2, is alkylene containing 1 to 6 carbon atoms.

24. A heat developable and heat stabilizable photographic composition as in claim 22 wherein B is an amine or isothiuronium moiety having a pKa value within the range of 8 to 12 and wherein said 2-carboxycarboxamide undergoes less than 10% weight loss, except loss due to water release, in a thermogravimetric scan between about 30° C and about 180° C where the scan rate is about 40° C per minute.

25. A heat developable photographic composition comprising (a) a photographic silver salt, (b) a photographic silver salt developing agent, (c) a binder, and (d) an activating concentration of an activator precursor having a pKa within the range of 8 to 14 and represented by the formula:

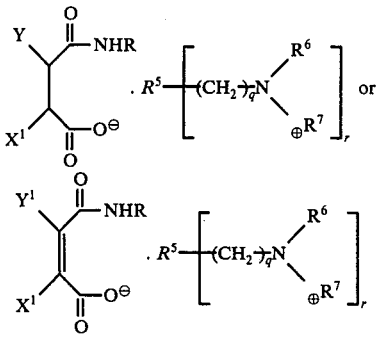

wherein Y, X, $Y^1$ and $X^1$ are individually selected from the group consisting of hydrogen and alkyl containing 1 to 4 carbon atoms or $Y^1$ and $X^1$ together represent the atoms necessary to complete a phenylene group;

R is selected from the group consisting of hydrogen, alkyl containing 1 to 10 carbon atoms,

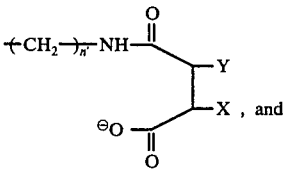

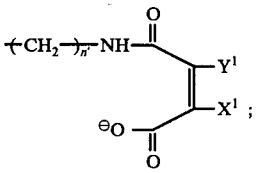

$n'$ is 1 to 6;

$q$ is 1 to 6;

$r$ is 1 or 2 and is an integer sufficient to form a neutral compound;

$R^6$ and $R^7$ are each selected from the group consisting of hydrogen and alkyl containing 1 to 4 carbon atoms;

$R^5$, when $r$ is 2, is selected from the group consisting of

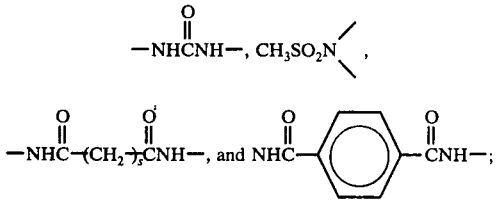

$s$ is 1 to 6;

$R^5$, when $r$ is 1, is

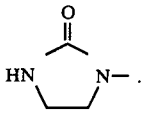

26. A heat developable photographic composition as in claim 25 wherein said activator precursor undergoes less than 10% weight loss, except loss due to water release, in a thermogravimetric scan between about 30° C and about 180° C where the scan rate is about 40° C per minute.

27. A method of developing an image in an exposed photographic element comprising a support having thereon (a) a photographic silver salt, (b) a photographic silver salt developing agent, (c) a binder, and (d) an activating concentration of an activator precursor having a base portion and an acid portion, wherein said acid portion is a 2-carboxycarboxamide; said (d) being contiguous to (a) and (b); comprising heating said element to a temperature within the range of about 120° C to 200° C for about 1 to about 60 seconds until an image is developed.

28. A method of developing and stabilizing an image in an exposed photographic element comprising a support having thereon a layer comprising (a) a photographic silver salt, (b) a photographic silver salt developing agent, (c) a binder and (d) an activating and stabilizing concentration of an activator-stabilizer precursor, said precursor being a 2-carboxycarboxamide represented by the formula:

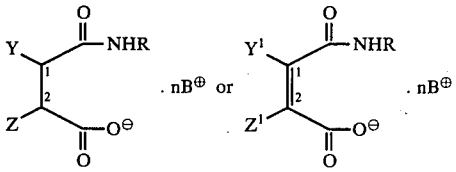

wherein B is a basic protonated nitrogen containing moiety;

$n$ is 1 or 2 and is an integer sufficient to form a neutral compound;

Y, Z, $Y^1$ and $Z^1$ are independently selected from the group consisting of hydrogen and alkyl containing 1 to 4 carbon atoms or $Y^1$ and $Z^1$ together represent the atoms necessary to complete a phenylene group;

R is selected from the group consisting of hydrogen, alkyl containing 1 to 10 carbon atoms,

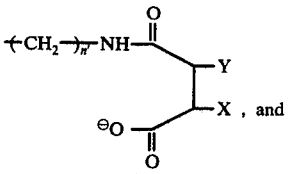

-continued

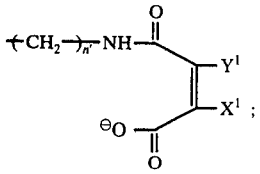

wherein $n'$ is 1 to 6; and X is the same as Z and $X^1$ is the same as $Z^1$; comprising heating said element to a temperature within the range of about 120° C to 200° C for about 1 to about 60 seconds until an image is developed and stabilized.

* * * * *

UNITED STATES PATENT AND TRADEMARK OFFICE

CERTIFICATE OF CORRECTION

PATENT NO. : 4,088,496

DATED : May 9, 1978

INVENTOR(S) : Paul B. Merkel

It is certified that error appears in the above-identified patent and that said Letters Patent are hereby corrected as shown below:

Column 4, line 7, "soons" should read ---soon---.

Column 7, lines 31-37, the formula should read as follows:

---

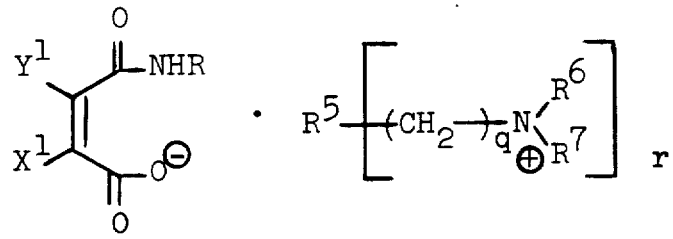

---.

Column 7, lines 48-54, the formula should read as follows:

---

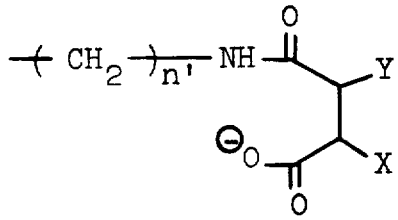

---.

UNITED STATES PATENT AND TRADEMARK OFFICE

CERTIFICATE OF CORRECTION

PATENT NO. : 4,088,496

DATED : May 9, 1978

INVENTOR(S) : Paul B. Merkel

It is certified that error appears in the above-identified patent and that said Letters Patent are hereby corrected as shown below:

Column 14, line 31, "desired" should read ---described---; lines 49-50, "concentraton" should read ---concentration---; line 55, "desired" should read ---described---.

Column 15, line 19, "activator-stabilizing" should read --- activator-stabilizer ---.

Column 18, line 44, "bromoidoide" should read ---bromoiodide---.

Column 19, line 20, the formula should read $$--- \quad (CH_3\text{-}\overset{CH_3}{\overset{|}{N}}\text{-}CH_2CH_2CH_2\text{-}NH\text{-}\overset{O}{\overset{\|}{C}}\text{-}NH\text{-}CH_2CH_2CH_2)_2 \quad ---.$$

Column 19, line 21, "bromoidodie" should read ---bromoiodide---.

Column 20, line 4, "1,4-bis(2-a,omp-2-thiazolinyl)" should read --- 1,4-bis(2-amino-2-thiazolinyl) ---.

Column 20, line 32, "slver" should read ---silver---.

UNITED STATES PATENT AND TRADEMARK OFFICE

CERTIFICATE OF CORRECTION

PATENT NO. : 4,088,496

DATED : May 9, 1978

INVENTOR(S) : Paul B. Merkel

It is certified that error appears in the above-identified patent and that said Letters Patent are hereby corrected as shown below:

Column 21, line 5, the formula should read as follows:

--- 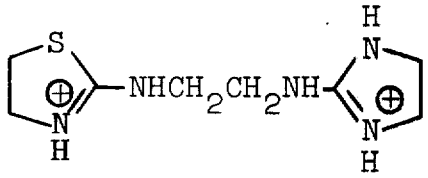 . ---.

Column 21, line 18, "bromoiodie" should read --- bromoiodide---.

Column 24, line 61, "1,3-bis[2S-(N,N-" should read --- 1,3-bis[2S-(N,N'- ---.

Column 28, line 40, before the structure insert

--- $R^3$ is $CH_3\overset{O}{\overset{\|}{C}}NH$ or $CH_3NH\overset{O}{\overset{\|}{C}}NH$ when $m^1$ is 1; or, when $m^1$ is 2, is $-NH\overset{O}{\overset{\|}{C}}NH-$, $O_2S\!<$ or $CH_3SO_2N\!<$; and ---.

UNITED STATES PATENT AND TRADEMARK OFFICE

CERTIFICATE OF CORRECTION

PATENT NO. : 4,088,496

DATED : May 9, 1978

INVENTOR(S) : Paul B. Merkel

It is certified that error appears in the above-identified patent and that said Letters Patent are hereby corrected as shown below:

Column 30, line 5, the formula should read as follows:

--- 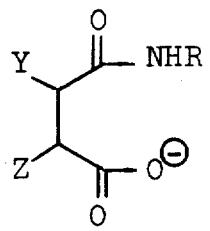 · $nB^{\oplus}$ or 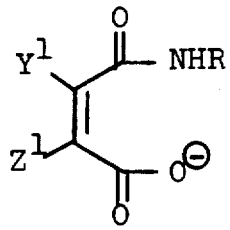 · $nB^{\oplus}$ ---.

Column 31, line 1, before the structure insert

---$R^3$ is $CH_3\overset{O}{\overset{\|}{C}}NH$ or $CH_3NH\overset{O}{\overset{\|}{C}}NH$ when $m^1$ is 1; or, when $m^1$ is 2, is $-NH\overset{O}{\overset{\|}{C}}NH-$, $O_2S\!<$ or $CH_3SO_2N\!<$; and ---.

Signed and Sealed this

Sixth Day of February 1979

[SEAL]

Attest:

RUTH C. MASON
Attesting Officer

DONALD W. BANNER
Commissioner of Patents and Trademarks